US008282248B1

(12) United States Patent
Burt

(10) Patent No.: US 8,282,248 B1
(45) Date of Patent: Oct. 9, 2012

(54) LUMINAIRE INCLUDING UPPER AND LOWER DOME-SHAPED OPTICAL ELEMENTS

(75) Inventor: Jonathan Burt, Tupelo, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 542 days.

(21) Appl. No.: 12/327,527

(22) Filed: Dec. 3, 2008

(51) Int. Cl.
*F21V 7/09* (2006.01)

(52) U.S. Cl. ..... 362/304; 362/147; 362/298; 362/351; 362/353

(58) Field of Classification Search ..... 362/131, 362/147, 298, 304, 311.01, 311.13, 311.14, 362/351, 353, 355, 356, 414, 302
See application file for complete search history.

(56) References Cited

U.S. PATENT DOCUMENTS

| | | | | | |
|---|---|---|---|---|---|
| 1,270,261 | A | * | 6/1918 | Brueggeman | 362/302 |
| 1,270,268 | A | * | 6/1918 | Crownfield | 362/277 |
| 1,286,535 | A | * | 12/1918 | Cochran | 362/302 |
| 1,319,186 | A | * | 10/1919 | Spencer | 362/293 |
| 1,618,055 | A | | 2/1927 | Champeau | |
| 1,692,069 | A | * | 11/1928 | Ames | 362/277 |
| 1,876,667 | A | * | 9/1932 | Gunnison | 362/303 |
| 1,973,086 | A | * | 9/1934 | Livers | 362/285 |
| 2,254,679 | A | * | 9/1941 | Gaskill | 362/277 |
| 2,755,374 | A | | 7/1956 | Ott | |
| 3,712,980 | A | | 1/1973 | Norton | |
| 4,096,555 | A | * | 6/1978 | Lasker | 362/302 |
| 4,231,080 | A | * | 10/1980 | Compton | 362/298 |
| 4,591,960 | A | * | 5/1986 | Jones | 362/298 |
| 4,829,410 | A | | 5/1989 | Patel | |
| 5,031,084 | A | | 7/1991 | Russo | |
| 5,111,370 | A | | 5/1992 | Clark | |
| 5,272,607 | A | | 12/1993 | Grimm | |
| 5,702,180 | A | * | 12/1997 | Huang | 362/410 |
| 5,967,646 | A | * | 10/1999 | Engel | 362/296.03 |
| 6,217,197 | B1 | * | 4/2001 | Siminovitch et al. | 362/297 |
| 6,369,326 | B1 | | 4/2002 | Rippel | |
| D463,058 | S | | 9/2002 | Nourishad | |
| 6,478,454 | B1 | | 11/2002 | Jaffari | |
| D469,562 | S | | 1/2003 | Crasset | |
| 6,572,246 | B1 | | 6/2003 | Hopp | |
| 6,874,914 | B2 | * | 4/2005 | Desanto et al. | 362/372 |
| 7,048,416 | B2 | | 5/2006 | Clark | |
| 7,744,254 | B2 | * | 6/2010 | Spiro | 362/297 |
| 2006/0158879 | A1 | | 7/2006 | Clark | |

* cited by examiner

*Primary Examiner* — Ismael Negron

(57) ABSTRACT

A direct and indirect luminaire has a stem, a generally dome shaped upper optical element, and a generally dome shaped lower optical element. The upper optical element is situated about a lamp axis and has a top that surrounds the stem and a reflective exterior surface that surrounds the stem and diverges away from the top toward a base of the upper optical element. The lower optical element is situated about the lamp axis and has a top with an uplight opening therethrough and a reflective interior surface that diverges away from the upper optical element toward a base of the lower optical element that has a downlight opening therethrough.

16 Claims, 4 Drawing Sheets

LUMINAIRE INCLUDING UPPER AND LOWER DOME-SHAPED OPTICAL ELEMENTS

CROSS-REFERENCE TO RELATED DOCUMENTS

Not Applicable.

TECHNICAL FIELD

This invention pertains generally to a luminaire, and more specifically to a suspended luminaire that provides direct and indirect lighting.

BRIEF DESCRIPTION OF THE ILLUSTRATIONS

DETAILED DESCRIPTION

Figure 1:
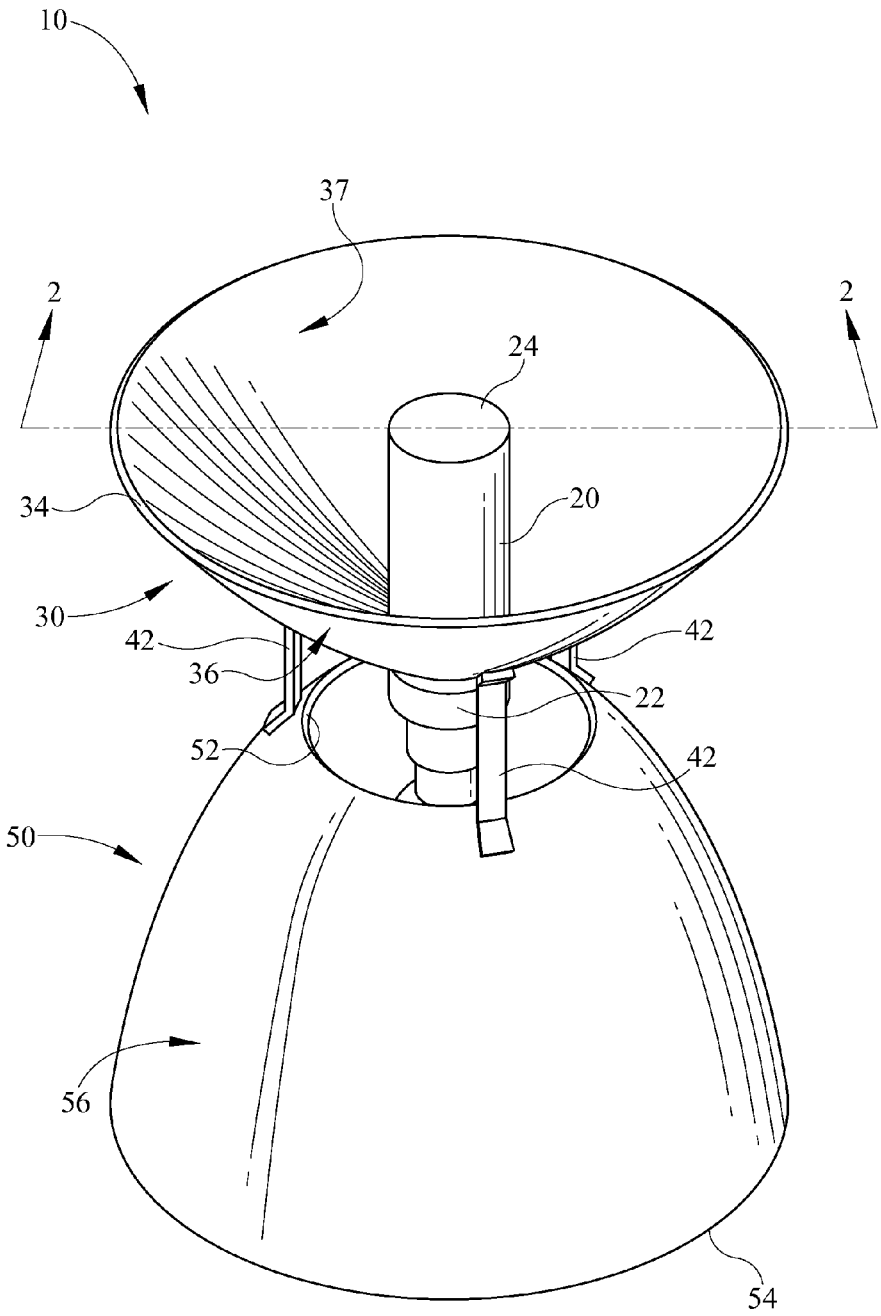
FIG. 1 is a top perspective view of one embodiment of the direct and indirect luminaire of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Figure 2:
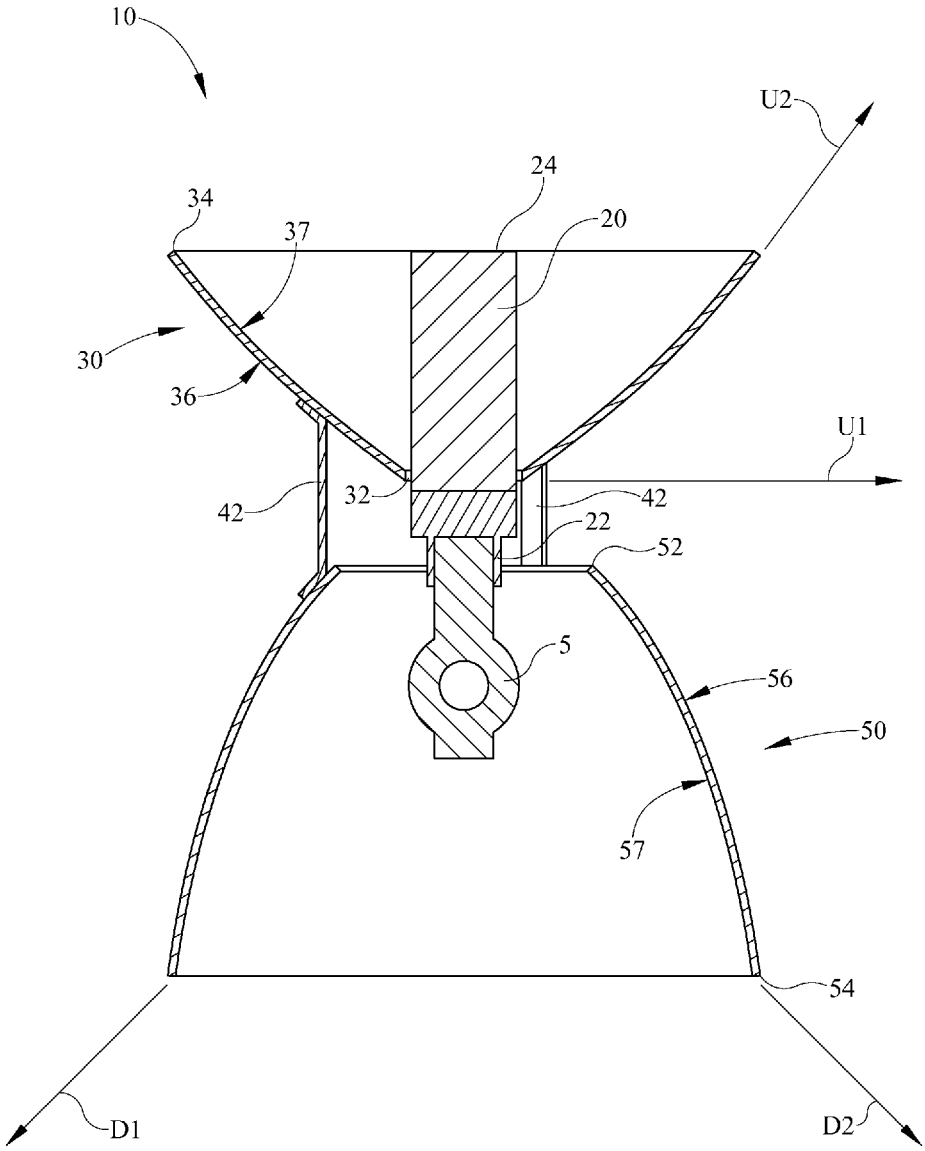
FIG. 2 is a side view, in section, of the direct and indirect luminaire of FIG. 1 taken along section line 2-2.

Referring now to FIG. 1 and FIG. 2, a first embodiment of a direct and indirect luminaire 10 has a stem 20, a generally dome shaped upper optical element 30, and a generally dome shaped lower optical element 50. Lower optical element 50 is situated about a lamp 5, which is in line with a lamp axis. In the depicted embodiments, lamp 5 is a metal halide lamp. In some embodiments lamp 5 is a T4.5 or T6 metal halide lamp. In some embodiments lamp 5 is another high intensity discharge lamp, such as, but not limited to, a high pressure sodium lamp. In yet other embodiments lamp 5 is a non-high intensity discharge lamp. Upper optical element 30 is positioned in substantially opposite relation to lower optical element 50 and is situated about stem 20. A reflective interior surface 57 of lower optical element 50 reflects light emitted by lamp 5 in a downward direction to provide downlighting. A reflective exterior surface 36 of upper optical element 30 reflects light emitted by lamp 5 in an upward direction to provide uplighting.

Stem 20 has a lamp socket 22 on one end thereof. Lamp socket 22 depicted throughout the Figures is configured to receive metal halide lamp 5. In other embodiments lamp socket 22 is configured to receive another high intensity discharge lamp, such as, but not limited to, a high pressure sodium lamp. In yet other embodiments lamp socket 22 is configured to receive a non-high intensity discharge lamp. Stem 20 is depicted as an elongated stem with an attachment portion 24 that may be coupled, directly or indirectly, to a mounting surface. For example, in some embodiments attachment portion 24 may be coupled to a hanging hook which may then be hooked to a mounting surface. For example, in other embodiments attachment portion 24 may be coupled to a cord, cable, or rigid stem that is coupled to a mounting surface. Also, electrical wiring for providing power to lamp socket 22 may run through all or portions of stem 20. In some embodiments, electrical wiring for providing power to lamp socket 22 may extend from a ballast which may be coupled to direct and indirect luminaire 10, such as, for example, at attachment portion 24, or may be provided remote from direct and indirect luminaire 10.

Upper optical element 30 in the depicted embodiments has a void in the interior portion and an interior surface 37 opposite reflective exterior surface 36. Having a void in the interior portion helps save on materials cost, but is not necessary. In some embodiments interior surface 37 is non-reflective. A top 32 of upper optical element 30 surrounds stem 20 proximate to lamp socket 22. Reflective exterior surface 36 diverges away from top 32 in an upward direction toward a base 34 of upper optical element 30. Base 34 in the depicted embodiments has a generally circular shape and is formed at the ends of reflective exterior surface 36. An opening is provided in base 34 in the depicted embodiments to save on material costs, but is not necessary.

Lower optical element 50 has a void in the interior portion and an exterior surface 56 opposite reflective interior surface 57. In some embodiments exterior surface 56 is painted for aesthetic purposes. A top 52 of lower optical element 50 is positioned proximal to lamp socket 22 and is provided with an uplight opening therethrough. The uplight opening may be provided with a transparent or translucent cover if desired. Reflective interior surface 57 diverges away from top 52 in a downward direction toward a base 54 of lower optical element 50. Base 54 is provided with a downlight opening therethrough. The downlight opening may be provided with a transparent or translucent cover if desired. In FIG. 1 and FIG. 2 upper optical element 30 is coupled to stem 20 at top 32. Supports 42 are coupled to and extend between upper optical element 30 and lower optical element 50 in order to support lower optical element 50.

Figure 4:
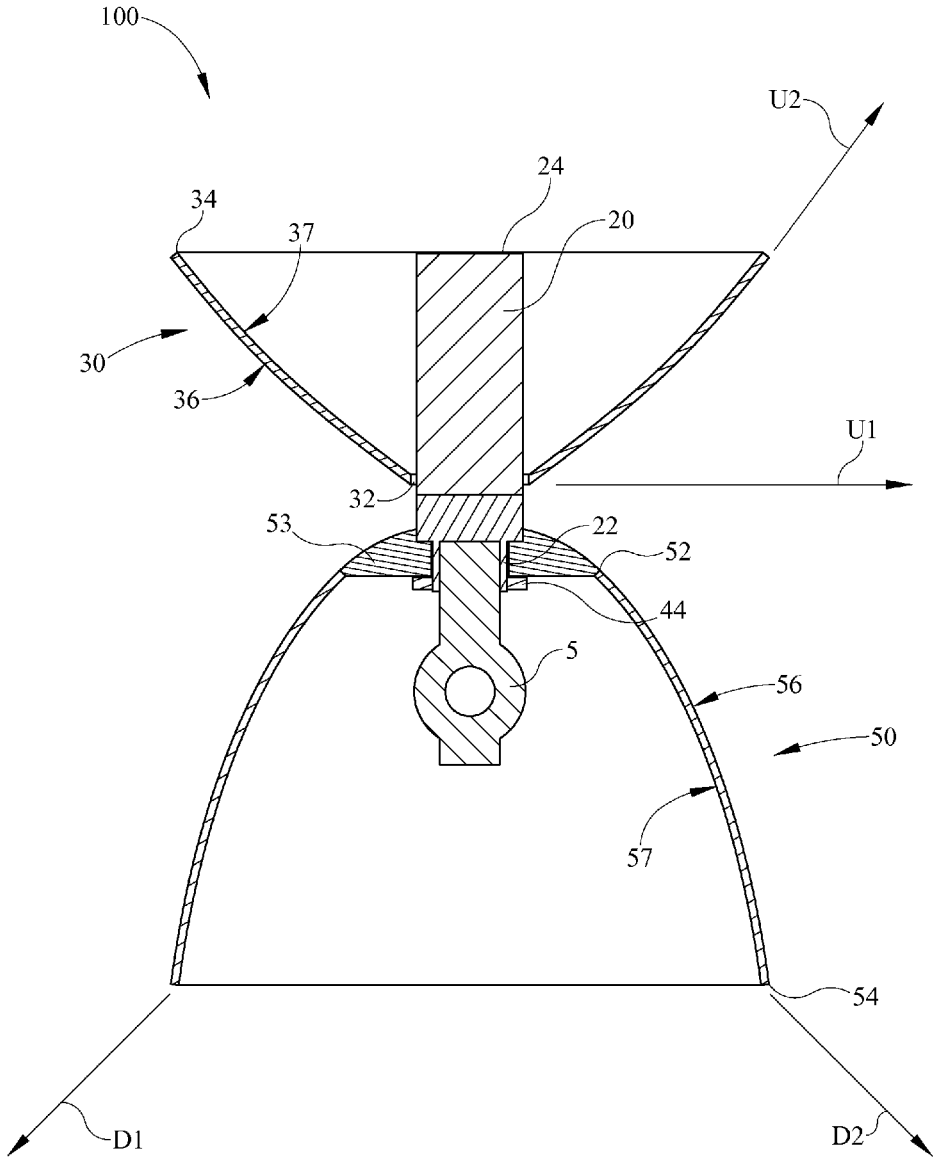
FIG. 4 is a side view, in section, of the direct and indirect luminaire of FIG. 3 taken along section line 4-4.

Reflective interior surface 57 of lower optical element 50 is shaped and positioned such that light emitted by lamp 5 that contacts reflective interior surface 57 is directed downwardly through the downlight opening formed through base 54. Other light emitted by lamp 5 passes through the downlight opening formed through base 54 without being reflected. As shown in FIG. 2 and FIG. 4, in the depicted embodiments a majority of the light passing through the downlight opening is directed within a range defined by arrows D1 and D2. Arrows D1 and D2 are directed approximately forty-five degrees off the lamp axis that is substantially in line with lamp 5. Alternative downlight distributions can be achieved. For example, alternative downlight distribution can be achieved through adjustment of the shape and/or positioning of reflective interior surface 57.

Reflective exterior surface 36 of upper optical element 30 is shaped and positioned such that a majority of light emitted by lamp 5 that passes through the uplight opening through top 52 and contacts reflective exterior surface 36 is directed upwardly. As shown in FIG. 2 and FIG. 4, in the depicted embodiments a majority of the light that contacts reflective exterior surface 36 is directed upwardly within a range defined by arrows U1 and U2. Arrow U1 is directed in a substantially perpendicular direction to the lamp axis that is substantially in line with lamp 5. Arrow U2 is approximately forty-five degrees off the lamp axis that is substantially in line with lamp 5. This configuration provides ample uplighting for an environment and minimizes the amount of light that is directed below arrow U1 that could cause discomfort to an individual viewing the light. Other light emitted by lamp 5 may pass through the uplight opening formed through top 52 and will be directed in an upwardly direction without being reflected by reflective exterior surface 36. Alternative uplight distributions can be achieved. For example, alternative uplight distributions can be achieved through adjustment of the shape and/or positioning of reflective exterior surface 36.

Figure 3:
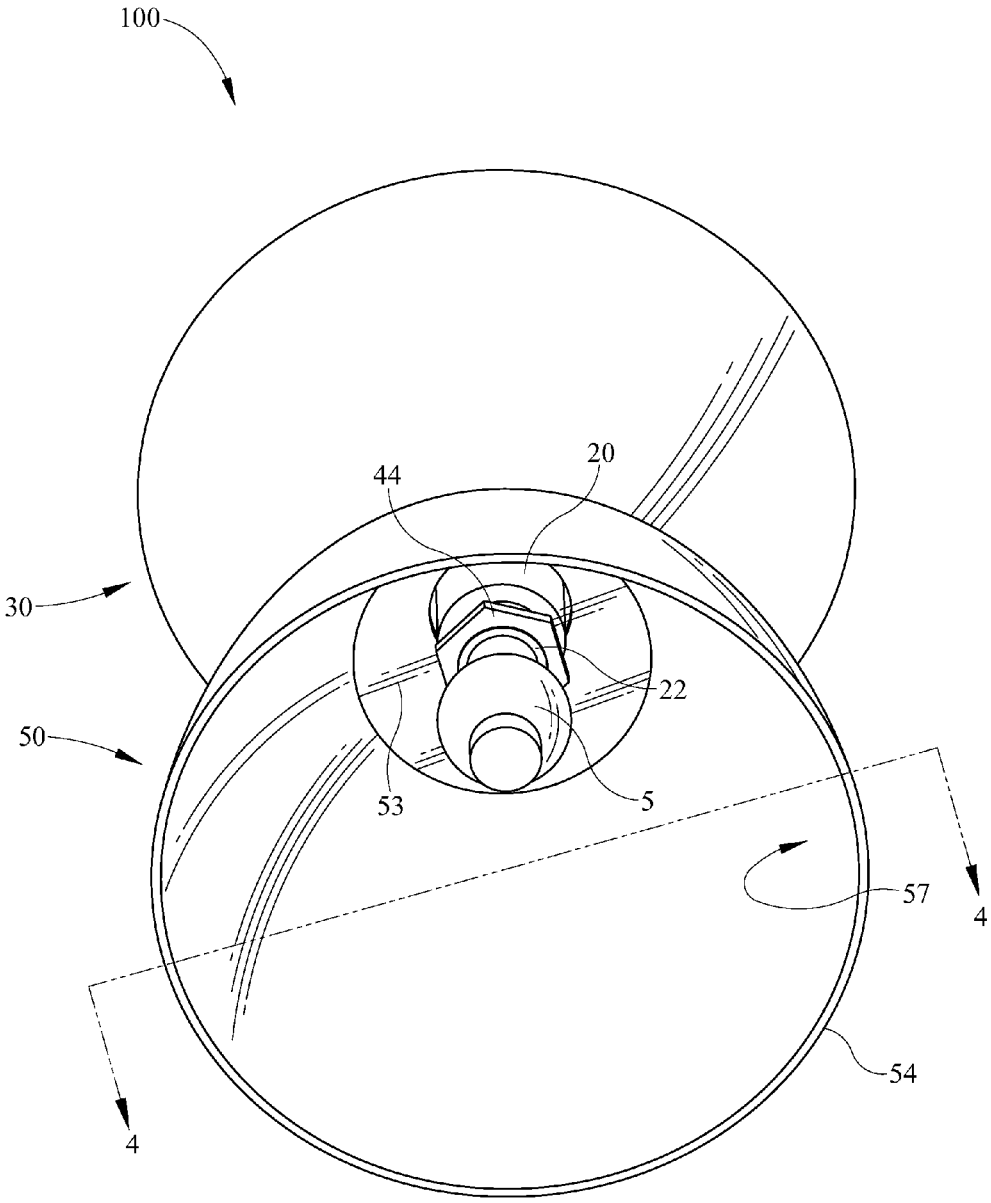
FIG. 3 is a bottom perspective view of another embodiment of the direct and indirect luminaire of the present invention.

Turning now to direct and indirect luminaire 100 of FIG. 3 and FIG. 4, upper optical element 30 is coupled to stem 20 at top 32. A glass cover 53 is provided over the uplight opening at top 52 of upper optical element 50 and is coupled to upper optical element 50. An attachment nut 44 mates with an exterior portion of socket 22 and contacts glass cover 53 in order to support lower optical element 50. The couplings between upper optical element 30, lower optical element 50, and stem 20 shown in the depicted embodiments are merely exemplary of couplings that may be used. For example, in other embodiments lower optical element 50 may be attached as depicted in FIG. 3 and FIG. 4, and supports may be coupled to and extend between lower optical element 50 and upper optical element 30 to support upper optical element 30. Also, for example, in other embodiments upper optical element 30 may be attached with an attachment nut that mates with exterior portions of stem 20 and contacts top 32, and supports may be coupled to and extend between upper optical element 30 and lower optical element 50 in order to support lower optical element 50. Other couplings between upper optical element 30, lower optical element 50, and stem 20 may be used.

The foregoing description has been presented for purposes of illustration. It is not intended to be exhaustive or to limit the invention to the precise forms disclosed, and obviously many modifications and variations are possible in light of the above teaching. It is understood that while certain forms of the direct and indirect luminaire have been illustrated and described, it is not limited thereto except insofar as such limitations are included in the following claims and allowable functional equivalents thereof.

I claim:

1. A luminaire for providing direct downlighting and indirect uplighting, comprising:

a stem having a lamp socket on one end thereof;

a generally dome shaped upper optical element situated about a lamp axis and having a top, a base, an interior surface, and a convex reflective exterior surface;

said top of said upper optical element surrounding said stem proximate said lamp socket, said reflective exterior surface surrounding said stem and diverging away from said top and said lamp socket toward said base;

a generally dome shaped lower optical element situated about said lamp axis, said lower optical element having a base with a downlight opening therethrough, a top with an uptight opening therethrough, and a reflective interior surface;

said uptight opening positioned proximal said top of said upper optical element, whereby in use, light originating within the lower optical element is reflected off of the reflective exterior surface to thereby provide at least some of the indirect uplighting; and, said reflective interior surface diverging away from said upper optical element toward said downlight opening.

2. The luminaire of claim 1, wherein said upper optical element and said lower optical element are each centered about said lamp axis.

3. The luminaire of claim 1, further comprising a lens provided over said uplight opening.

4. The luminaire of claim 1, wherein said upper optical element is directly coupled to said stem.

5. The luminaire of claim 4, wherein said lower optical element is directly coupled to said stem.

6. A luminaire that provides direct downlighting and indirect uplighting, comprising:

a stem having a lamp socket on one end thereof;

a generally dome shaped upper optical element having a top, a base, an interior surface, a convex reflective exterior surface, and an interior portion with a void;

said top of said upper optical element surrounding said stem proximate said lamp socket, said reflective exterior surface surrounding said stem and diverging away from said top and said lamp socket in an upward direction toward said base;

a generally dome shaped lower optical element positioned in substantially opposite relation to said upper optical element;

said lower optical element having a base with a downlight opening therethrough, a top with an uptight opening therethrough, and a reflective interior surface;

said uptight opening positioned proximal said top of said upper optical element, whereby in use, light originating within the lower optical element is reflected off of the reflective exterior surface to thereby provide at least some of the indirect uplighting; and, said reflective interior surface diverging away from said upper optical element in a downward direction toward said downlight opening.

7. The luminaire of claim 6, further comprising a lens provided over said downlight opening.

8. The luminaire of claim 6, wherein said upper optical element is directly coupled to said stem.

9. The luminaire of claim 6, wherein said lower optical element is directly coupled to said stem.

10. The luminaire of claim 6, wherein said upper optical element and said lower optical element are each centered about a common axis.

11. The luminaire of claim 10, wherein said stem is an elongated stem extending along the common axis.

12. A luminaire that provides direct downlighting and indirect uplighting, comprising:

an elongated stem having a lamp socket for receiving HID lamps on one end thereof;

a generally dome shaped upper optical element having a top, a base, an interior surface, a convex reflective exterior surface, and an interior portion with a void;

said top of said upper optical element surrounding said stem proximate said lamp socket, said reflective exterior surface surrounding said stem and diverging away from said top and said lamp socket in an upward direction toward said base, said base having an opening therethrough;

a generally dome shaped lower optical element having a base with a downlight opening therethrough, a top with an uptight opening therethrough, and a reflective interior surface;

said uptight opening positioned proximal said top of said upper optical element, whereby in use, light originating within the lower optical element is reflected off of the reflective exterior surface to thereby provide at least some of the indirect uplighting; and, said reflective interior surface diverging away from said upper optical element in a downward direction toward said downlight opening.

13. The luminaire of claim 12, wherein said upper optical element is directly coupled to said stem.

14. The luminaire of claim 12, wherein a plurality of supports directly couple said lower optical element to said upper optical element.

15. The luminaire of claim 12, wherein said upper optical element and said lower optical element are each centered about a common axis.

16. The luminaire of claim 15, wherein said stem is an elongated stem extending along the common axis.

* * * * *